US009058796B2

(12) United States Patent
Dunwoodie

(10) Patent No.: US 9,058,796 B2
(45) Date of Patent: Jun. 16, 2015

(54) MAGNETICALLY MOUNTED PICKUP FOR STRINGED INSTRUMENTS

(71) Applicant: David Dunwoodie, Delta (CA)

(72) Inventor: David Dunwoodie, Delta (CA)

( * ) Notice: Subject to any disclaimer, the term of this patent is extended or adjusted under 35 U.S.C. 154(b) by 29 days.

(21) Appl. No.: 13/917,911

(22) Filed: Jun. 14, 2013

(65) Prior Publication Data

US 2013/0333545 A1 Dec. 19, 2013

Related U.S. Application Data

(60) Provisional application No. 61/659,938, filed on Jun. 14, 2012.

(51) Int. Cl.
*G10H 3/18* (2006.01)
*G10H 3/14* (2006.01)

(52) U.S. Cl.
CPC ..... *G10H 3/181* (2013.01); *G10H 3/146* (2013.01); *G10H 3/183* (2013.01); *G10H 2220/531* (2013.01)

(58) Field of Classification Search
USPC ..... 84/726
See application file for complete search history.

(56) References Cited

U.S. PATENT DOCUMENTS

| | | | | |
|---|---|---|---|---|
| 8,680,389 | B2 * | 3/2014 | Yamanaka | 84/725 |
| 2010/0031800 | A1 * | 2/2010 | Ekstrom | 84/291 |

* cited by examiner

*Primary Examiner* — Christopher Uhlir

(57) ABSTRACT

Improved pickups for stringed instruments, such as guitars, ukuleles, banjos and the like. The pickup system includes a housing with a transducer element and a first magnetic means, and a distinct second magnetic means that cooperates with the first magnetic means to grasp a part of the instrument there between and thereby releasably mount the pickup on the instrument. Thus the pickup system can be easily mounted, removed or moved to other locations on the stringed instrument to produce the most desirable effect.

6 Claims, 1 Drawing Sheet

MAGNETICALLY MOUNTED PICKUP FOR STRINGED INSTRUMENTS

BACKGROUND OF THE INVENTION

1. Field of Invention

The present invention relates generally to pickups for stringed instruments, and more particularly to pickups for acoustical guitars.

2. Description of Related Art

Some stringed instruments, such as acoustical guitars, require the addition of a pickup if the sound of the guitar is to be amplified or modified electronically. Typically, the pickup, comprising an input transducer element such as a piezoelectric element, a piezoelectric film or an electret condenser film, is mounted underneath the saddle or at some other desired location on the guitar body by screws or other fastening means, for example adhesive glue, adhesive tape, putty and wax. Some modification of the guitar body is usually required with conventional pickups, and once mounted the pickup becomes a fixture to the guitar or is moveable but with considerable effort and/or marring of the instrument. When the guitar is used unamplified, the pick is simply not plugged in but remains on the instrument for use if amplification of the sound is later required. In addition to acoustical guitars, such pickups are commonly used on other acoustical stringed instruments such as banjos, ukuleles and the like.

Rather than modifying an acoustical guitar or other stringed instrument by mounting a fixed pickup, it would be desirable to have an easily removable and moveable pickup system that is easy to mount onto the guitar or other stringed instrument, and also easy to remove without damaging the instrument. Accordingly, it would be advantageous to have an improved pickup system and method for securing a pickup to a stringed instrument body such as a guitar body.

SUMMARY OF THE INVENTION

In accordance with one aspect of the invention, a removable pickup system for mounting on a part of a stringed instrument comprising: a housing having first magnetic means for placement on one side of the part; a transducer element received within the housing that converts mechanical energy into electrical energy; electrical conduits connected to the transducer for conducting the electrical energy to a desired device; a second magnetic means that is physically distinct from the housing for placement on a side opposition of the one side of the part; and wherein the first magnetic means and the second magnetic means provide sufficient magnetic attraction between them to grasp the part to retain the pickup system on the part in a manner that allows it to be deliberately removed by a user.

The invention further provides a method of removably mounting a pickup on a part of a stringed instrument, the method comprising the steps of: providing a housing having first magnetic means, a transducer element received within the housing that converts mechanical energy into electrical energy, electrical conduits connected to the transducer for conducting the electrical energy to a desired device; positioning the housing with the first magnetic means against the part; providing a second magnetic means that is physically distinct from the housing; and positioning the second magnetic means on a side opposition of the one side of the part until the first magnetic means and the second magnetic means provide sufficient magnetic attraction between them to grasp the part to retain the pickup system on the part in a manner that allows it to be deliberately removed by a user.

The components described herein are also designed to fit or retrofit most instruments without any modification to the original instrument.

Advantageously, the pickup system of the present invention can be easily moved on the instrument without damage or marring of the instrument to a location that produces the most desirable result as determined by the user for a particular application. For example, the pickup can be moved even while in use to various locations on the sound board as the users strums the guitar, which allows the user to compare the varying effects produced at such locations. Thereby, the user can quickly determine the location of the pickup that produces the most pleasing effect. This is not possible or done easily with conventional pickup systems for stringed instruments.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

Figure 1:
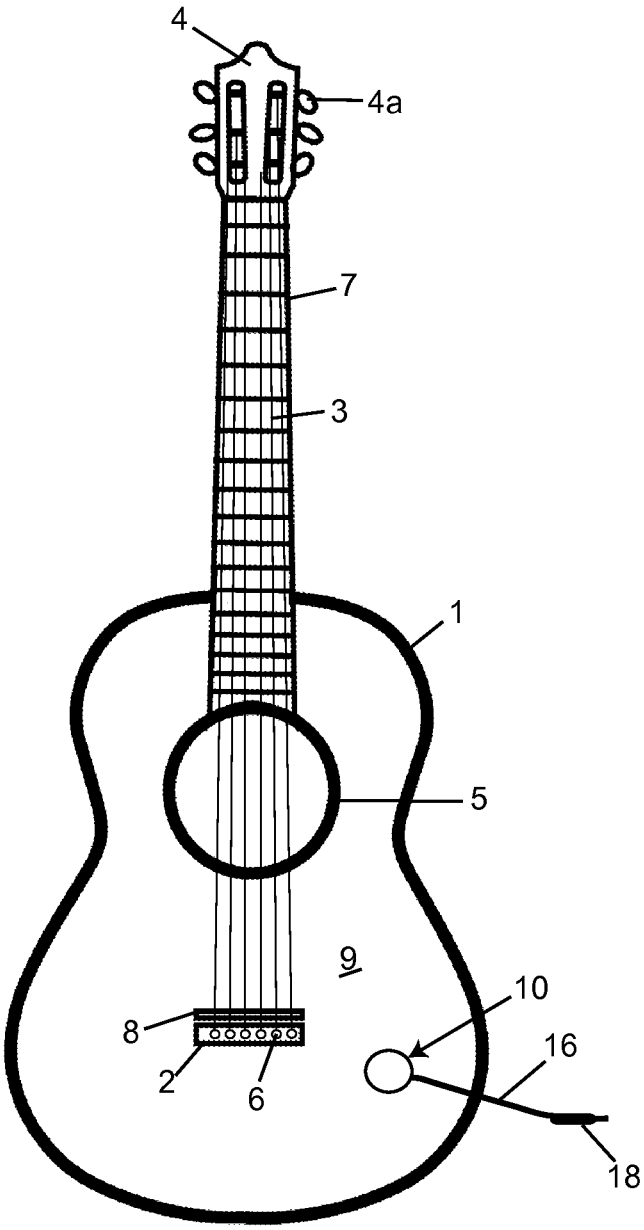
FIG. 1 exemplary top view of a stringed instrument, namely a conventional acoustical guitar shown with an embodiment of the present pickup system mounted on the guitar body.

Referring to FIG. 1 there is shown an exemplary top view of an acoustical guitar comprises a main guitar body 1 with a longitudinally extending neck member 7. The neck member extends from the body and has a distal end or guitar head 4 having a plurality of string receiving and tightening members 4*a* which retain a first end of each of the strings 3. A bridge 2 is connected to the guitar body 1 remote from the neck member. Strings 3 extend between bridge 2 and the string receiving and tightening members 4*a* such that the strings can be releasably placed under tension. The second end of each of the guitar strings 3 are inserted into respective pin holes on the bridge 2, and then fixed by respective bridge pins 6. When the strings are tightened, string tension presses the strings against the saddle 8 and presses the saddle against the body. When the instrument is played, vibrational energy from the strings is transmitted through the saddle and into the guitar top 9, also known as the sound board, and into the body of the instrument where the vibrational energy resonates and produces sound. Some of the sound waves within the body leave via the sound hole 5. Also shown removably mounted on a part of the guitar, namely the sound board 9 of guitar body 1 as illustrated is an embodiment of a pickup of the present invention shown generally by reference number 10.

Figure 2:
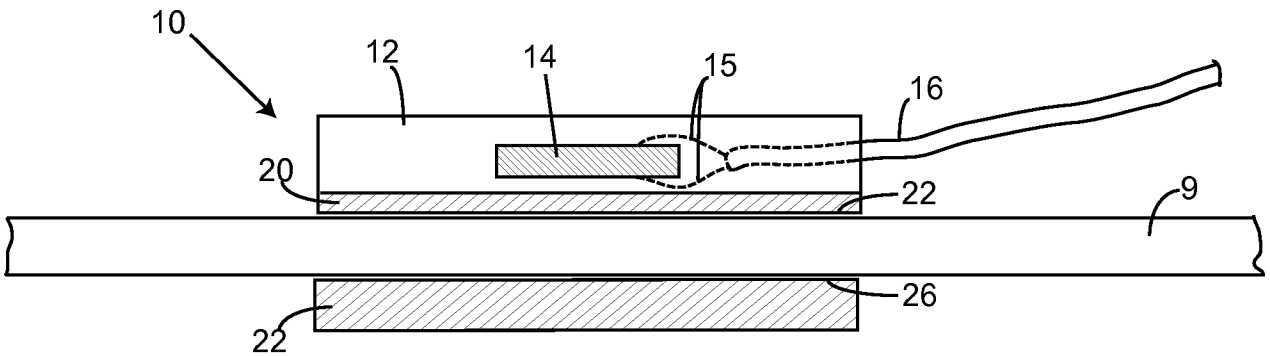
FIG. 2 a cross section view of the pickup of FIG. 1.

Referring in particular to FIG. 2, pickup 10 comprises a metal or plastic pickup housing 12 that supports or houses an input transducer element 14 that converts mechanical energy to electrical energy. Some common examples of such transducers are piezoelectric elements, piezoelectric films or electret condenser films. The transducer element 14 converts the vibrational energy of the sound board 9 or other part of the instrument to which it is mounted into electrical energy that can be amplified or otherwise modified electrically in an amplifier or the like. The electrical output of the transducer element 14 is transmitted to the amplifier or other electronic device (not shown) via contact wires 15 leading from the transducer element to respective wires of an electrical cable 16 that terminates in a conventional jack 18 for quick releasable connection with such electronic devices or compatible extension cables.

The housing 12 includes or is attached to a first magnetic means 20 which can be either a magnet or a metal that is attracted by a magnet. The magnetic means 20 includes a flat surface 22 that is adapted to abut the outer surface of the guitar top/sound board 9. Further provided is a second magnetic means 24 that is distinct form the housing 12 and that also has a flat surface 26 for abutting the inside surface of the sound board 9. In the case where the first magnetic means is a magnet ("first" magnet) then the second magnetic means may be either a metal attracted to the first magnet or another magnet ("second" magnet). If both are magnets, then their poles must be oriented such that they attract each other rather then repel. In the case where the first magnetic means is a metal, then the second magnetic means must be a magnet. As shown in FIG. 2, the housing 12 is mounted on the outer surface of the sound board 9 in a desired location such that the first magnetic means faces the sound board, and the second magnetic means 24 is mounted on the inside surface of the sound board such that its flat surface 26 abuts the sound board, and the second magnetic means is positioned adjacent the first magnetic means so that they attract through the sound board and thereby engage the sound board. Accordingly, the pickup 10 is thereby releasably mounted to the guitar body at a desired location which provides desired vibrational energy to the transducer element.

The magnets may comprise a compact high-strength magnet such as a rare earth magnet like samarium-cobalt and neodymium-iron-boron (NIB) magnets. The important aspect is that the first magnetic means and the second magnetic means must provide sufficient attraction to each other through the particular structure of the stringed instrument at which the pickup is to be located to enable the pickup 10 to be sufficiently retained on the instrument without being susceptible to being moved or dislodged by normal movements of the instrument, but that allows the two magnetic means to be separated from each other to enable the deliberate removal of the pickup 10 form the instrument.

While the transducer element is described as one that translates mechanical energy into electrical energy, there is present development on accelerometer based pickups, and it is contemplated that such elements may also be used as the transducer element with the present invention.

In use, the housing 12 is held with the first magnetic means against the outside surface of the sound board 9 of the guitar and the second magnetic means is placed on the opposite side of the sound board 9 via the sound hole 5 such that the two magnetic means attract each other and thereby grasp the sound board between them to retain the pickup system on the guitar. The jack 18 is plugged into the appropriate electrical device. If the desired location of the pickup is remote from the sound hole 5 such that a user would find it difficult to reach into the body 1 to place the second magnetic means adjacent the housing, then the device would be first be mounted near the sound board and then slid into position from the outside of the guitar while the user slightly lifts up the housing (and perhaps places a piece of fabric or felt between the first magnetic means and the sound board) so as not to mar the sound board. The magnetic attraction between the magnetic means maintains the second magnetic means in proximity of the first magnetic means as the pickup system is slid into place. If fabric or felt was used, it may be slid out from underneath the first magnetic means once the pickup system is in the desired location so as not to dampen the vibrational energy being imparted to the pickup housing 12 (hence transducer 14). Accordingly, an advantage of the present invention is that the pickup system can be easily moved on the instrument, without damage or marring of the instrument, to a location that produces the most desirable result as determined by the user.

While the above description and illustrations constitute preferred or alternate embodiments of the present invention, it will be appreciated that numerous variations may be made without departing from the scope of the invention. Thus, the embodiments described and illustrated herein should not be considered to limit the invention as construed in accordance with the accompanying claims.

The invention claimed is:

1. A removable pickup system for mounting on an acoustic stringed instrument having a sound board, the system comprising:

a housing having first magnetic means for placement on one side of the sound board;

a transducer element received within the housing that converts mechanical energy into electrical energy;

electrical conduits connected to the transducer for conducting the electrical energy to a desired device;

a second magnetic means that is physically distinct from the housing for placement on a side opposition of the one side of the sound board; and wherein the first magnetic means and the second magnetic means provide sufficient magnetic attraction between them through the sound board to releasably retain the pickup system on the sound board.

2. The system of claim 1 wherein the first magnetic means comprises a metal and the second magnetic means comprises a magnet, wherein the metal is of a kind attracted by the magnet.

3. The system of claim 1 wherein the first magnetic means and the second magnetic means each comprises a magnet and wherein the polarities of the magnets are arranged to produce attraction between them.

4. The system of claim 2 wherein the magnet is a rare earth magnet.

5. The system of claim 3 wherein the magnets are rare earth magnets.

6. A method of removably mounting a pickup on a sound board of an acoustic stringed instrument, the method comprising the steps of:

providing a housing having first magnetic means, a transducer element received within the housing that converts mechanical energy into electrical energy, electrical conduits connected to the transducer for conducting the electrical energy to a desired device;

positioning the housing with the first magnetic means against one side of the sound board;

providing a second magnetic means that is physically distinct from the housing; and positioning the second magnetic means on a side opposition of the one side of the sound board until the first magnetic means and the second magnetic means provide sufficient magnetic attraction between them through the sound board to releasably retain the pickup system on the sound board.

* * * * *